US009482993B2

(12) United States Patent
Yagi

(10) Patent No.: US 9,482,993 B2
(45) Date of Patent: Nov. 1, 2016

(54) IMAGE FORMING APPARATUS HAVING CONTAINERS FOR TONERS INCLUDING WAX

(71) Applicant: CANON KABUSHIKI KAISHA, Tokyo (JP)

(72) Inventor: Yasutaka Yagi, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/810,153

(22) Filed: Jul. 27, 2015

(65) Prior Publication Data

US 2016/0026121 A1 Jan. 28, 2016

(30) Foreign Application Priority Data

Jul. 28, 2014 (JP) ..... 2014-152887

(51) Int. Cl.
*G03G 15/16* (2006.01)
*G03G 15/20* (2006.01)

(52) U.S. Cl.
CPC ..... *G03G 15/161* (2013.01); *G03G 15/2075* (2013.01); *G03G 2215/0132* (2013.01); *G03G 2215/0607* (2013.01); *G03G 2215/2035* (2013.01)

(58) Field of Classification Search
CPC ..... G03G 15/161; G03G 15/2025; G03G 2215/0132; G03G 2215/1647
USPC ..... 399/101, 223, 252, 346
See application file for complete search history.

(56) References Cited

U.S. PATENT DOCUMENTS 8,313,878 B2 * 11/2012 Kuramashi ..... G03G 9/0821 399/252
8,611,800 B2 * 12/2013 Kawamata ..... G03G 15/161 399/346

* cited by examiner

*Primary Examiner* — William J Royer
(74) *Attorney, Agent, or Firm* — Fitzpatrick, Cella, Harper & Scinto

(57) ABSTRACT

An image forming apparatus includes: an image forming portion; a transfer member; a fixing portion; and a cleaning member. The image forming apparatus includes a first toner container containing a first formulation toner rich in hydrocarbon wax and a second toner container containing a second formulation toner rich in ester wax. The image forming apparatus is capable of executing an image forming operation and an operation in a toner supplying mode for supplying the toner or the toners to an intermediary transfer member when the image forming operation is not performed. The image forming apparatus is capable of executing the operation in the toner supplying mode in which only the first formulation toner is used or a mixture of the first formulation toner and the second formulation toner is used so that the first formulation toner is used in a larger amount than the second formulation toner.

8 Claims, 3 Drawing Sheets

(a)

(b)

(a)

(b)

IMAGE FORMING APPARATUS HAVING CONTAINERS FOR TONERS INCLUDING WAX

FIELD OF THE INVENTION AND RELATED ART

The present invention relates to an image forming apparatus, of an intermediary transfer type, such as a copying machine or a printer using an electrophotographic process or the like.

In a conventional electrophotographic image forming apparatus of an intermediary transfer type, a photosensitive member using a photoconductive substance is used as an image bearing member and an electrostatic latent image is formed on the photosensitive member by various means. Then, the electrostatic latent image is developed with a toner, and a toner image obtained by developing the latent image is once primary-transferred onto an intermediary transfer member by using a primary transfer roller and then is secondary-transferred onto a recording material such as paper by using a secondary transfer roller. Then, the recording material is introduced into a fixing device (fixing portion), in which the toner image is fixed as a fixed image, so that a print image is obtained.

Here, the toner is color particles (powder) for visualizing (developing) the latent image by being deposited on the latent image formed on the image bearing member. A one-component developer is in the form of only a toner (non-magnetic or magnetic). A two-component toner is in the form of a mixture of this toner (non-magnetic or magnetic) or a carrier (magnetic or non-magnetic).

The fixing device includes a rotatable heating member (heating film or heating roller) and a rotatable pressing member (hereinafter referred to as a pressing roller) between which a fixing nip is formed. In the fixing nip, the recording material is nipped and fed to be heated and pressed, so that the toner image is fixed on the recording material. Such a fixing device is used for many purposes. The rotatable heating member contacts a surface (front surface) of the recording material in a toner image carrying side, and the pressing roller contacts a surface (back surface) of the recording material in an opposite side from the toner image carrying side.

As a means for removing a transfer residual toner remaining on the intermediary transfer member after the secondary transfer, a blade cleaning type using a rubber cleaning blade has been widely employed. In such an image forming apparatus, in order to prevent generation of an excessive frictional force between the cleaning blade and the intermediary transfer member, the toner as a lubricant is periodically supplied to the cleaning blade portion (so-called toner purging). As a result, lubricity between the cleaning blade and the intermediary transfer member is maintained. Such a method is employed.

In the toner used for image formation, as an additive for improving a fixing property, a wax as a parting agent is contained. Further, in order to improve the fixing property, an image forming method in which species of the wax is changed depending on a color, specifically a toner for black (K) contains a hydrocarbon wax and toners for other colors (yellow (Y), magenta (M), cyan (C)) contain an ester wax has been proposed (Japanese Laid-Open Patent Applications Hei10-97098 and 2000-10377).

During the toner purging, in order to prevent the purged toner on the intermediary transfer member from being deposited on the intermediary transfer member, a voltage of the same polarity as a polarity of the purged toner is applied to the secondary transfer roller. However, it is difficult to sufficiently prevent deposition of the purged toner on the secondary transfer roller, and therefore a part of the purged toner deposits on the secondary transfer roller, so that the deposited toner is transferred onto the back surface of the recording material during subsequent secondary transfer in some cases.

In the case where the toner purging is carried out using the toner containing the wax, the purged toner includes the toner containing the ester wax poor in parting property during high temperature. Therefore, when the recording material on which the purged toner is transferred at the back surface is heated and pressed as described above, it turned out by study of the present inventor that the following problem arisen.

That is, of the purged toner deposited on the back surface of the recording material, the toner (component) containing the ester wax has a poor parting property during high temperature, and therefore is liable to deposit on the surface of the pressing roller in the fixing device. The purged toner deposited on a parting layer surface of the pressing roller is not readily detached and becomes larger in amount with an increasing print number, so that a so-called pressing roller contamination generates and causes a lowering in image quality in some cases. Such a problem occurs.

SUMMARY OF THE INVENTION

According to an aspect of the present invention, there is provided an image forming apparatus for forming a toner image on a recording material, comprising: an image forming portion for forming the toner image, formed with toners of a plurality of colors, on an intermediary transfer member; a transfer member for forming a transfer nip in contact and cooperation with the intermediary transfer member, the transfer member transferring the toner image from the intermediary transfer member onto the recording material while feeding the recording material in the transfer nip; a fixing portion for fixing the toner image on the recording material by heating the recording material on which the toner image is transferred while feeding the recording material in a fixing nip, the fixing portion including a heating member and a pressing member for forming the fixing nip in cooperation with the heating member; and a cleaning member for cleaning a surface of the intermediary transfer member in contact with the intermediary transfer member, the cleaning member being provided between the image forming portion and the transfer nip with respect to a movement direction of the intermediary transfer member, wherein toner particles of each of the toners contain a binder resin and a wax which is contained in an amount of 3 weight parts or more per 100 weight parts of the binder resin, wherein the image forming apparatus at least includes a first toner container containing a first formulation toner in which the wax is only a hydrocarbon wax or a mixture of the hydrocarbon wax and a wax other than the hydrocarbon wax which is contained in a larger amount than the wax and includes a second toner container containing a second formulation toner in which the wax is only an ester wax or a mixture of the ester wax and a wax other than the ester wax which is contained in a larger amount than the wax, wherein the image forming apparatus is capable of executing an image forming operation for forming the toner image on the intermediary transfer member at the image forming portion to form the toner image on the recording material, and is capable of executing an operation in a toner supplying mode for supplying the toner or the toners to the intermediary transfer member at the image forming portion to dispose the toner or the toners between the cleaning member and the intermediary transfer member at predetermined timing when the image forming operation is not performed, and wherein the image forming apparatus is capable of executing the operation in the toner supplying mode in which only the first formulation toner is used or a mixture of the first formulation toner and the second formulation toner is used so that the first formulation toner is used in a larger amount than the second formulation toner.

According to another aspect of the present invention, there is provided an image forming apparatus for forming a toner image on a recording material, comprising: an image forming portion for forming the toner image, formed with toners of a plurality of colors, on an intermediary transfer member; a transfer member for forming a transfer nip in contact and cooperation with the intermediary transfer member, the transfer member transferring the toner image from the intermediary transfer member onto the recording material while feeding the recording material in the transfer nip; a fixing portion for fixing the toner image on the recording material by heating the recording material on which the toner image is transferred while feeding the recording material in a fixing nip, the fixing portion including a heating member and a pressing member for forming the fixing nip in cooperation with the heating member; and a cleaning member for cleaning a surface of the intermediary transfer member in contact with the intermediary transfer member, the cleaning member being provided between the image forming portion and the transfer nip with respect to a movement direction of the intermediary transfer member, wherein toner particles of each of the toners contain a binder resin and a wax which is contained in an amount of 3 weight parts or more per 100 weight parts of the binder resin, wherein the image forming apparatus at least includes a first toner container containing a first formulation toner in which a compatible amount of the wax with the binder resin measured by differential scanning colorimetric analysis is less than a predetermined amount and includes a second toner container containing a second formulation toner in which the compatible amount of the wax with the binder resin is the predetermined amount or more, wherein the image forming apparatus is capable of executing an image forming operation for forming the toner image on the intermediary transfer member at the image forming portion to form the toner image on the recording material, and is capable of executing an operation in a toner supplying mode for supplying the toner or the toners to the intermediary transfer member at the image forming portion to dispose the toner or the toners between the cleaning member and the intermediary transfer member at predetermined timing when the image forming operation is not performed, and wherein the image forming apparatus is capable of executing the operation in the toner supplying mode in which only the first formulation toner is used or a mixture of the first formulation toner and the second formulation toner is used so that the first formulation toner is used in a larger amount than the second formulation toner.

These and other objects, features and advantages of the present invention will become more apparent upon a consideration of the following description of the preferred embodiments of the present invention taken in conjunction with the accompanying drawings.

DESCRIPTION OF THE EMBODIMENTS

With reference to the drawings, Embodiments of the present invention will be described. The following embodiments do not limit the scope of the present invention, and all of combinations of features described in the following embodiments are not always essential to solve the problem of the present invention.

[Image Forming Apparatus]

Figure 1:
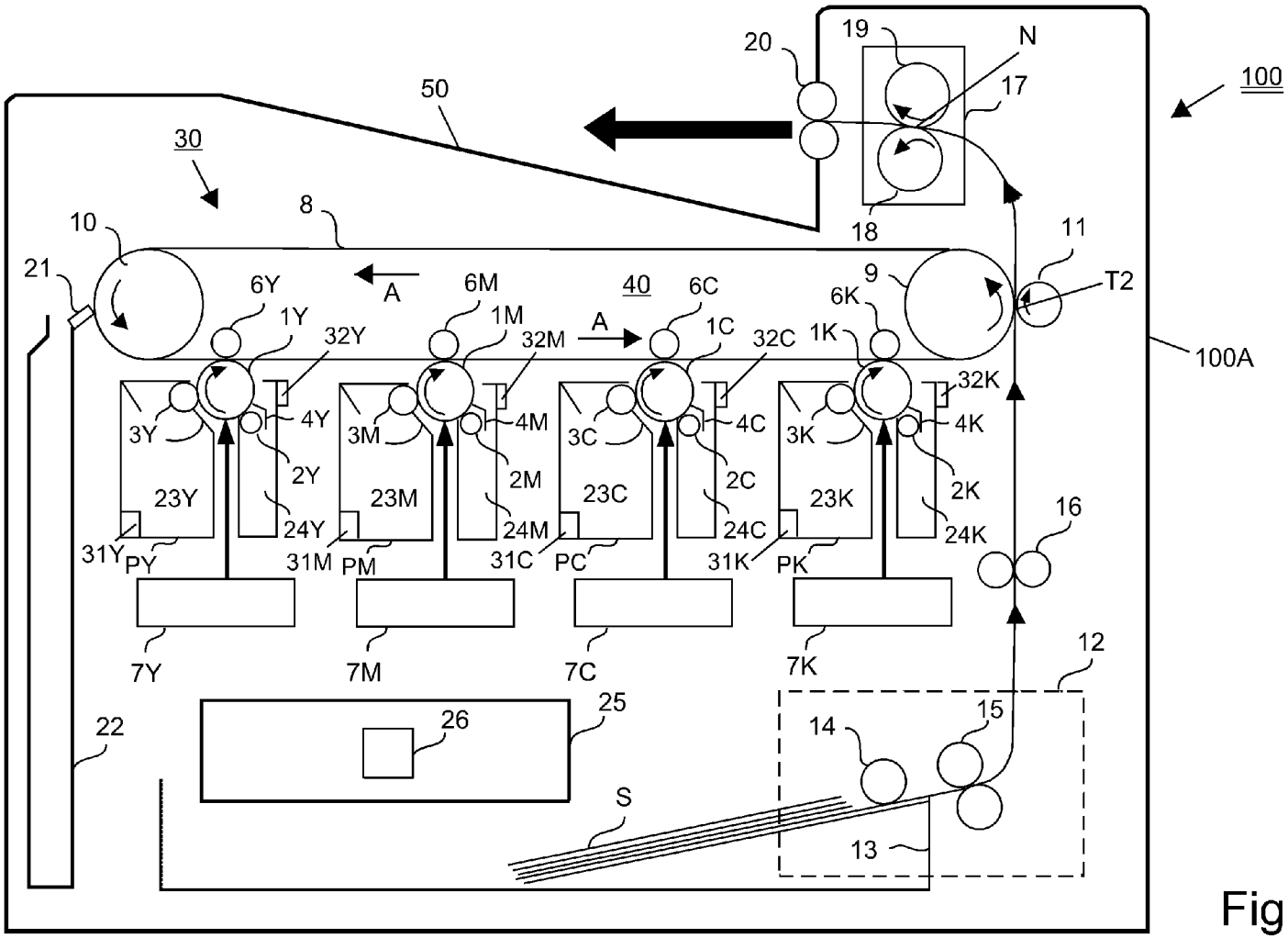
FIG. 1 is a schematic structural view of an example of an image forming apparatus.

FIG. 1 is a schematic structural view of an example of an image forming apparatus 100 of an intermediary transfer type in which a toner image forming portion for forming toner images on a moving intermediary transfer member by toner of at least two colors is provided. The image forming apparatus 100 in this embodiment is an electrophotographic full-color image forming apparatus of a 4 drum type and the intermediary transfer type.

A toner image forming portion 30 forms, on an intermediary transfer member 8, toner images of a plurality of colors, i.e., superposed toner images of four colors of yellow (Y), magenta (M), cyan (C) and black (K) in this embodiment. The toner image forming portion 30 includes four process cartridges P (PY, PM, PC, PK) each detachably mountable to an image forming apparatus main assembly 100A. The toner image forming portion 30 includes an intermediary transfer belt unit 40 using an intermediary transfer belt 8 as the intermediary transfer member.

The four process cartridges PY, PM, PC, PK have the same structure. A difference is that the image is formed with the toner, of an associated color, accommodated in the process cartridge P, i.e., is formed with the toner of yellow (Y), magenta (M), cyan (C) or black (K).

The process cartridges PY, PM, PC and PK include toner containers 23Y, 23M, 23C, 23K, respectively. The process cartridges PY, PM, PC, PK further include photosensitive drums 1Y, 1M, 1C, 1K as image bearing members, charging rollers 2Y, 2M, 2C, 2K, developing rollers 3Y, 3M, 3C, 3K, drum cleaning blades 4Y, 4M, 4C, 4K, and residual toner containers 24Y, 24M, 24C, 24K.

Below the process cartridges PY, PM, PC, PK, laser units 7Y, 7M, 7C, 7K are provided, and the photosensitive drums 1Y, 1M, 1C, 1K are subjected to exposure to light based on image signals. The photosensitive drums 1Y, 1M, 1C, 1K are rotationally driven in the clockwise direction indicated by arrows at a predetermined peripheral speed. Then, the photosensitive drums 1Y, 1M, 1C, 1K are electrically charged to a predetermined negative(−polarity) potential by applying a predetermined negative voltage to the charging rollers 2Y, 2M, 2C, 2K, and thereafter are subjected to scanning exposure by the laser units 7Y, 7M, 7C, 7K, so that electrostatic latent images are formed.

These electrostatic latent images are reversely developed by applying a predetermined negative voltage to the developing rollers 3Y, 3M, 3C, 3K, so that toner images (negative) of the colors of Y, M, C, K are formed on the photosensitive drums 1Y, 1M, 1C, 1K. The process cartridges PY, PM, PC, PK include detecting members 31Y, 31M, 31C, 31K for detecting remaining amounts of the toners and storing means 32Y, 32M, 32C, 32K for storing detection results of the detecting members 31Y, 31M, 31C, 31K.

The intermediary transfer belt unit 40 is constituted by a flexible endless intermediary transfer belt 8, and a driving roller 9 and a follower roller 10 which stretch the intermediary transfer belt 8. Inside the intermediary transfer belt 8, primary transfer rollers (transfer members) 6Y, 6M, 6C, 6K are provided opposed to the photosensitive drums 1Y, 1M, 1C, 1K, respectively, and contact the intermediary transfer belt 8. A contact portion between each of the photosensitive drums 1Y, 1M, 1C, 1K and the intermediary transfer belt 8 is a primary transfer nip. To each of the primary transfer rollers 6Y, 6M, 6C, 6K, a transfer voltage is applied by an unshown voltage applying means.

The intermediary transfer belt 8 is rotated (moved) by rotational drive of the driving roller 9 in the counterclockwise direction of arrows A at a peripheral speed corresponding to the rotational peripheral speed of the photosensitive drums 1. The negative toner images formed on the photosensitive drums 1Y, 1M, 1C, 1K are successively primary-transferred superposedly onto the intermediary transfer belt 8 by applying a positive voltage to the primary transfer rollers 6Y, 6M, 6C, 6K.

That is, on the surface of the intermediary transfer belt 8, the toner images of the four colors of Y, M, C, K are successively transferred in this order in a superposed state. Then, the toner images are fed by further rotation of the intermediary transfer belt 8 to a secondary transfer nip T2 which is a contact portion between the intermediary transfer belt 8 and a secondary transfer roller (transfer member) 11.

A feeding device 12 includes a feeding roller 14 for feeding a recording material S from a recording material cassette 13 in which sheets of the recording material S are stacked and accommodated, and includes a feeding roller pair 15 for feeding the fed recording material S. The recording material S fed from the feeding device 12 is introduced into the secondary transfer nip T2 at predetermined control timing by a registration roller pair 16, and is nipped and fed in the secondary transfer nip T2. To the secondary transfer roller 11, a positive voltage is applied. As a result, onto the recording material S nipped and fed in the secondary transfer nip T2, the superposed four color toner images are secondary-transferred collectively from the intermediary transfer belt 8.

Accordingly, on the (front) surface of the recording material S passed through the secondary transfer nip T2, the toner images of K, C, M, Y which are reversed in the order of superposition from those on the intermediary transfer belt 8 are formed. That is, on the recording material S, the superposed four color toner images including a downmost layer of the toner image of K and an uppermost layer of the toner image of Y are formed.

The recording material S on which the toner images are formed by the secondary transfer in the above-described manner is introduced into a fixing device 17. The recording material S subjected to heat-fixing of the toner images in the fixing device 17 is discharged onto a discharge tray 50 by a discharging roller pair 20.

In each of the process cartridges PY, PM, PC, PK, the toner remaining on the photosensitive drum surface after the primary transfer of the toner image from an associated one of the photosensitive drums 1Y, 1M, 1C, 1K onto the intermediary transfer belt 8 is removed by an associated one of the cleaning blades 4Y, 4M, 4C, 4K. The toner (transfer residual toner) remaining on the surface of the intermediary transfer belt 8 after the secondary transfer of the toner images from the intermediary transfer belt 8 onto the recording material S is removed by a cleaning blade 21 counter-directionally contacted to the intermediary transfer belt 8. The removed toner is collected in a residual toner collecting container 22.

On a control substrate 25 provided with an electrical circuit for effecting control of the image forming apparatus 100, CPU 26 as a controller is mounted. The CPU 26 collectively controls an operation of the image forming apparatus 100 including control of a driving source (not shown) relating to feeding of the recording material S and a driving source (not shown) for the intermediary transfer belt 8 and the process cartridges PY, PM, PC, PK, control relating to image formation, control relating to failure detection, and the like control.

The CPU 26 stores, in the storing means 32Y, 32M, 32C, 32K, detection results of remaining toner amount in the toner containers 23Y, 23M, 23C, 23K detected by detecting members 31Y, 31M, 31C, 31K in the process cartridges PY, PM, PC, PK in a renewing manner. The CPU 26 compares the remaining toner amount with a predetermined remaining amount threshold and then causes a display portion (not shown) to display a message prompting a user to exchange the cartridge in which the remaining toner amount is the threshold or less.

[Fixing Device]

Figure 2:
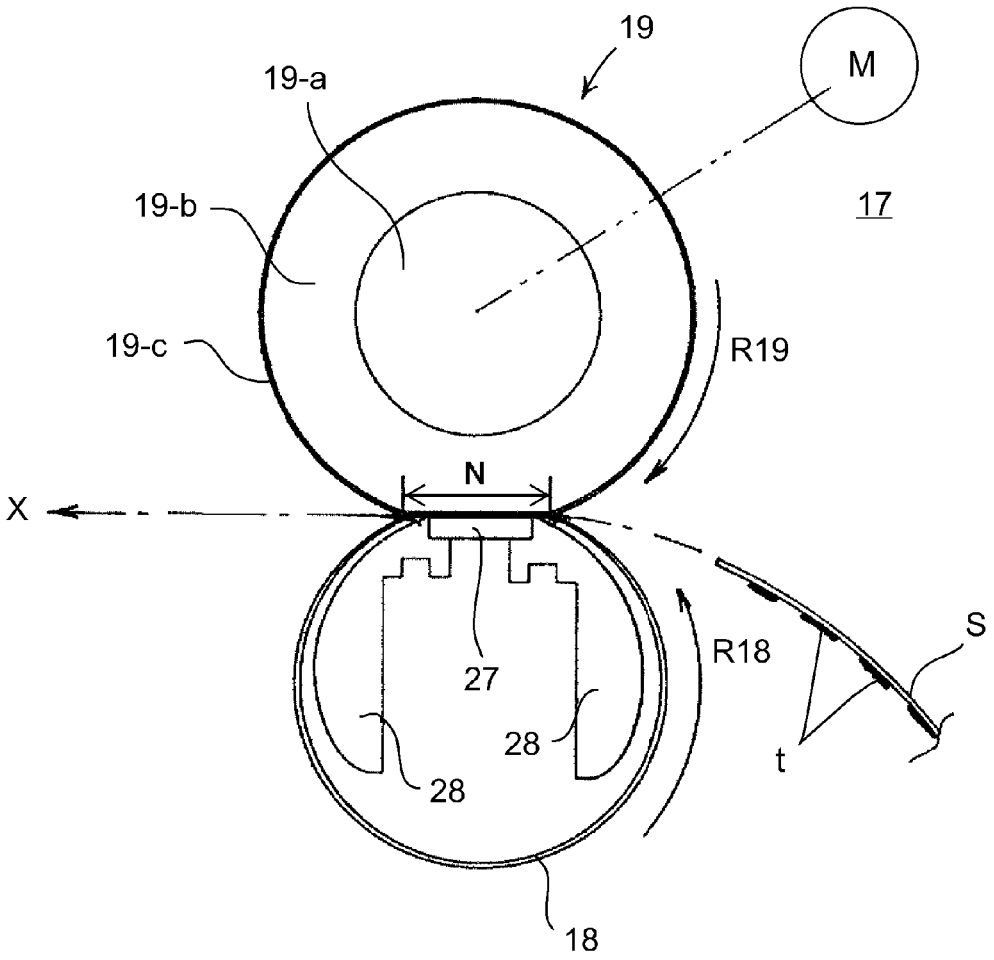
FIG. 2 is a schematic structural view of a fixing device.

FIG. 2 is a schematic cross-sectional view showing a structure of a principal part of the fixing device 17 in this embodiment. The fixing device 17 is of a film heating type and a rotatable pressing member drive type, and includes a heat-resistant endless belt (cylindrical) film 18 as the rotatable heating member and an elastic pressing roller 19 as the rotatable pressing member which form the fixing nip N in contact with each other. At least a part of the film 18 is always in a tension-free state, and is rotationally driven by a rotational driving force of the pressing roller 19.

In the fixing nip N, the film 18 contacts the surface (front surface) of the recording material S in a toner carrying side, and the pressing roller 19 contacts the surface (back surface) of the recording material S in a side opposite from the toner carrying side (surface).

A stay 28 is a heat-resistant rigid member as not only a heat generating means holding member but also a film guide member. A ceramic heater (heat generating means) 27 is provided at a lower surface of the stay 28 along a longitudinal direction of the stay 28. The film 18 is loosely fitted around the stay 28 which is the film guide member and which includes the heat generating means 27. That is, an inner circumferential length of the film 18 and an outer circumferential length of the stay 28 including the heat generating means 27 are set so that the circumferential length of the film 18 is longer than that of the stay 28 by, e.g., about 3 mm, so that the film 18 is externally engaged with the stay 28 with an allowance.

The stay 28 can be constituted by a high-heat-resistant resin material such as polyimide, polyamideimide, PEEK, PPS, or a liquid crystal polymer or by a composite material of these resin materials with ceramics, metal, glass or the like. In this embodiment, the liquid crystal polymer was used.

As the film 18, a single-layer film of a heat-resistant material such as PTFE, PFA or FEP formed in a thickness of 100 μm or less, preferably 80 μm or less and 20 μm or more. Alternately, a composite-layer film obtained by coating PTFE, PFA, FEP or the like on an outer surface of a film of polyimide, polyamideimide, PEEK, PES, PPS or the like can be used. In this embodiment, a composite-layer film obtained by coating PTFE on an outer surface of an about 60 μm-thick polyimide film was used. An outer diameter of the film 18 was 24 mm.

The pressing roller 19 includes a core metal 19-*a*, an elastic layer 19-*b* and a parting layer (outermost layer) 19-*c*. In this embodiment, aluminum was used for the core metal 19-*a*, silicone rubber was used for the elastic layer 19-*b*, and an about 50 μm-thick PFA tube was used for the parting layer 19-*c*. The pressing roller 19 was 30 mm in outer diameter, 3 mm in thickness 55° in product hardness (ASKER-C), and 200 N in pressure to be applied to the film 18.

The pressing roller 19 sandwiches the film 18 itself and the ceramic heater 27, and press-contacts the film 18 against elasticity of the elastic layer 19-*b*, so that the fixing nip N having a predetermined width with respect to a recording material feeding direction X. The pressing roller 19 is rotationally driven by a driving system M in the clockwise direction of an arrow R19 at a predetermined peripheral speed. Then, by a frictional force between the pressing roller 19 and the film center surface in the fixing nip N, the film 18 is rotated in the direction of an arrow R18 while closely contacting and sliding with the ceramic heater 27 at the film inner surface.

The pressing roller 19 is rotationally driven and the film 18 is rotated by the drive of the pressing roller 19, and electric energy (power) is supplied to the ceramic heater 27, so that the ceramic heater 27 is increased in temperature up to a predetermined temperature and is temperature-controlled. In such a state, the recording material S carrying a toner image t thereon is introduced into the fixing nip N. In a process in which the recording material S is nipped and fed in the fixing nip N, the recording material S is heated and pressed, so that the toner image t is fixed on the surface of the recording material S. In the fixing nip N, the film 18 is heated by the ceramic heater 27, and the toner image t is heated by heat of the film 18 heated by the ceramic heater 27.

[Timing of Execution of Toner Purging]

As described above, the cleaning blade 21 is a blade-shaped cleaning means for removing the residual toner on the intermediary transfer belt 8. The cleaning blade 21 is formed of, e.g., an elastic rubber of urethane or the like, and is press-contacted counterdirectionally to the intermediary transfer belt 8 at pressure of about 0.49 N/cm as linear pressure.

In general, a large frictional force generates between the cleaning blade 21 and the intermediary transfer belt 8. When the frictional force is large, the cleaning blade 21 causes distortion, with the result that a gap is formed between the cleaning blade 21 and the intermediary transfer belt 8, and through which, the toner passes and thus a cleaning performance cannot be satisfied in some cases. Further, in some cases, a free end of the elastic rubber portion contacted counterdirectionally to the intermediary transfer belt 8 is turned up.

In order to prevent such phenomena, a process of reducing the frictional force by applying a powdery lubricant onto an edge portion of the cleaning blade 21 and then by causing the cleaning blade 21 to press-contact the intermediary transfer belt 8 is performed in some cases. However, when continuous sheet passing is effected, an amount of the lubricant gradually decreases. Therefore, in order to continuously maintain the cleaning performance, there is a need to periodically supply the lubricant to the cleaning blade 21.

In this embodiment, the toner performs the function as the lubricant. That is, the CPU (controller) 26 executes a toner purging operation (operation in a toner supplying mode) in which the toner is supplied to the intermediary transfer belt 8 at the toner image forming portion 30 at predetermined timing so that the toner is disposed (interposed) between the intermediary transfer belt 8 and the cleaning blade 21.

Figure 3:
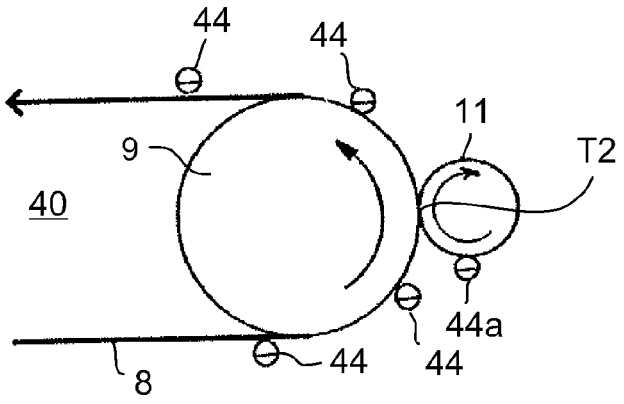
In FIG. 3, (a) and (b) are illustrations each showing a deposition path of a purged toner.
Figure 3:
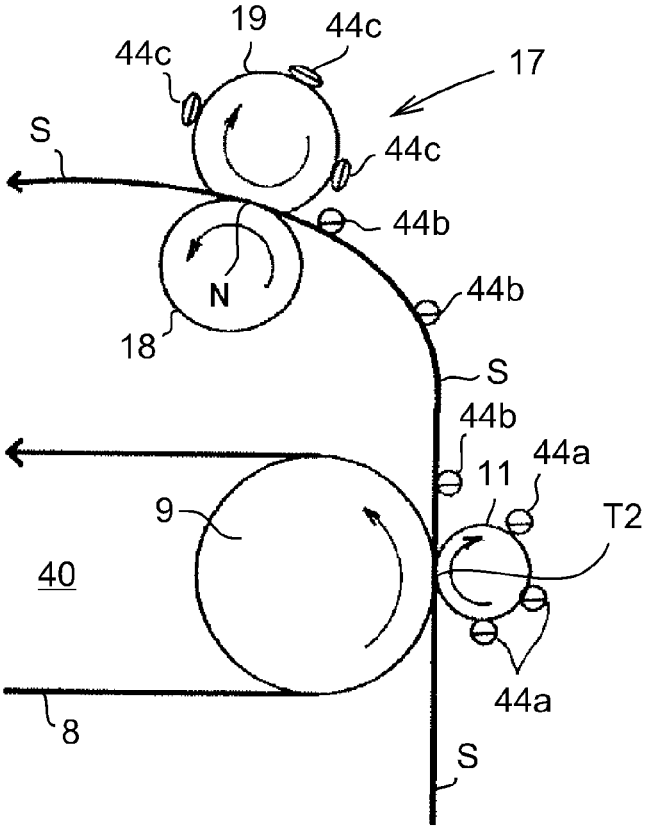

In the following, for convenience, the toner supplied to the cleaning blade 21 by the toner purging operation is referred to as a purged toner 44 (FIG. 3). This purged toner 44 is, similarly as during normal image formation, used for developing a latent image on the photosensitive drum in an appropriate pattern such as an elongated stripe pattern with respect to a generatrix direction of the photosensitive drum and then is primary-transferred onto the intermediary transfer belt 8. The purged toner 44 passes through the secondary transfer nip T2, which is a contact portion between the intermediary transfer belt 8 and the secondary transfer roller 11, by further rotation of the intermediary transfer belt 8, and is fed and supplied to the edge portion of the cleaning blade 21, so that the purged toner 44 performs the function as the lubricant.

When the purged toner 44 on the intermediary transfer belt 8 passes through secondary transfer nip T2 of the secondary transfer roller 11, in order to cause the purged toner 44 to be less deposited on the surface of the secondary transfer roller 11, a voltage of the negative polarity identical to the polarity of the purged toner 44 is applied to the secondary transfer roller 11.

The toner purging operation is carried out depending on the number of times of rotation of the intermediary transfer belt 8 at timing when an image forming operation for forming the toner image on the recording material S is not performed by the image forming apparatus 100. Examples of the execution timing in this embodiment are shown in Table 1.

TABLE 1

| RPS*1 | CP*2 | 4IP*3 | 2IP*4 | 1IP*5 |
|---|---|---|---|---|
| ET*6 | 200 | 122 | 88 | 56 |

*1"RPS" is the recording material size. In this embodiment, letter-sized paper and A4-sized paper were used.
*2"CP" represents continuous printing.
*3"4IP" represents 4-sheet-intermittent printing.
*4"2IP" represents 2-sheet-intermittent printing.
*5"1IP" represents 1-sheet-intermittent printing.
*6"ET" represents execution timing (every predetermined print number of sheets). For example, "200" represents that the toner purging operation is performed every 200 sheets.

The above examples of the execution timing are merely illustratively shown, and therefore the toner purging operation may also be executed in a period between the recording material and a subsequent recording material in a print job of two or more sheets, i.e., during a so-called sheet interval.

However, as described above, even when the negative voltage is applied to the secondary transfer roller 11, it is difficult to sufficiently prevent deposition of the purged toner 44 on the secondary transfer roller 11, so that a part of the purged toner 44 deposits on the secondary transfer roller 11 in a small amount as indicated by a reference symbol 44*a* in (a) of FIG. 3. Then, as shown in (b) of FIG. 3, the deposited toner 44*a* moves from the secondary transfer roller 11 and deposits on the back surface of the recording material S as indicated by a reference symbol 44*b* during the next secondary transfer in some cases.

Then, the recording material S is introduced into the fixing nip N and is nipped and fed in the fixing nip N, so that the purged toner 44*b* depositing on the back surface of the recording material S is liable to deposit on the surface of the pressing roller 19 as indicated by a reference symbol 44*c* in (b) of FIG. 3. The purged toner 44 once deposited on the surface of the parting layer 19-*c* of the pressing roller 19 is not readily detached, and increases in amount with an increasing print number, so that a so-called pressing roller contamination generates and also causes a lowering in image quality.

Therefore, in this embodiment, in order to suppress the pressing roller contamination, the following means is taken.

[Toner]

The toner used in this embodiment is a non-magnetic toner which has a particle size of 5-8 μm and which is substantially spherical. In the image forming apparatus in this embodiment, as described above, the toner is transferred two times in total by the primary transfer and the secondary transfer, and therefore a spherical toner having a good transfer property.

The toner used in this embodiment is manufactured by a polymerization method, but becomes substantially spherical in shape by the nature of the manufacturing method, so that the toner is constituted so that a core contains a wax therein, and a binder resin layer formed on the core comprises styrene-butylacrylate resin, and thereon, a layer of styrene-polyester resin is formed as an outermost shell. In order to stabilize a charging performance and to impart a lubricating property, an external additive is added. As the binder resin used for the toner, it is possible to use a vinyl copolymer comprising a styrene-based resin material and an acrylic-based resin material, or polyester resin material, and the like.

The wax will be described in detail. The present inventor has studied on an image forming method capable of solving the above-described problem. Particularly, the study was made on the wax to be incorporated in the toner. As a result, the present inventor has found that the above effect is very effectively achieved by controlling a species and a compatible amount of the wax.

[Species and Compatible Amount of Wax]

According to study by the present inventor, in the case of an ester wax, the ester wax is very easily compatible with the binder resin in toner particles, and therefore it turned out that the binder resin is easily plasticized (softened) during the fixing process. As a result, the softened resin easily bonds individuals of the toner particles to each other, so that the resin is liable to deposit on the surface of the parting layer 19-*c* of the pressing roller 19 in the fixing device 17 to the extent that the deposited resin cannot be prevented by only a parting effect of the wax, and therefore the pressing roller contamination is liable to generate.

On the other hand, in the case of a hydrocarbon wax, compared with the ester wax, the hydrocarbon wax is not readily compatible with the binder resin in the toner particles, and therefore the binder resin is not readily plasticized (softened) during the fixing process compared with the case of the ester wax. For that reason, the hydrocarbon wax does not readily deposit on the surface of the parting layer 19-*c* of the pressing roller 19, so that the pressing roller contamination can be suppressed.

Also a correlation of the compatible amount of the wax with the pressing roller contamination was clarified by the study of the present inventor. Specifically, in differential scanning calorimeter (DSC), in the case where a wax compatible amount of the ester wax is 2.0 weight % or more (predetermined amount A weight % or more), the pressing roller contamination is liable to generate. In the case where the wax compatible amount of the ester wax is 2.0 weight % or more, this means that the wax easily compatible with the binder resin is contained in a large amount in the toner particles.

When the compatible wax is contained in the binder resin in a large amount, the wax plasticizers the binder resin during the fixing process, so that the resin is softened. As a result, when an excessively softened resin exists in a large amount, the resin deposits on the surface of the parting layer 19-*c* of the pressing roller 19 to the extent that the deposition cannot be prevented by the parting effect of the wax. Accordingly, in order to suppress the pressing roller contamination, there is a need that the compatible amount of the ester wax with the toner is less than 2.0 weight % (less than the predetermined amount A weight %).

As the wax usable in the toner, it is possible to cite the following waxes. These waxes are used singly or in mixture of two or more species.

1) Hydrocarbon Wax

It is possible to cite paraffin wax, microcrystalline wax, petroleum wax such as petrolatum, and derivatives thereof; montan wax and its derivative; hydrocarbon wax obtained by Fischer-Tropsh process and its derivatives; and polyolefin wax such as polyethylene wax or polypropylene wax and derivatives thereof.

2) Ester Wax

It is possible to cite natural wax such as carnauba wax or candelilla wax and derivatives thereof, and ester wax.

3) Other Waxes.

It is possible to cite ketone, hydrogenated castor oil and derivatives thereof; vegetable wax; animal wax; and silicone wax.

The content of the wax may preferably be 3.0 weight parts or more and 20.0 weight parts or less per 100.0 weight parts of the binder resin, more preferably 5.0 weight parts or more and 15.0 weight parts or less per 100.0 weight parts of the binder resin.

[Measurement of Wax Compatible Amount]

A measuring method of the wax compatible amount will be described. The wax compatible amount is obtained from heat absorption amounts of the toner and the wax measured by the differential scanning calorimetry (DSC). As an analyzing device, "Q1000", manufactured by TA Instruments is used, and measurement is made in accordance with ASTM D3418-82. A temperature correction of a detecting portion of the device is made using melting points of indium and zinc, and a correction of heat quantity is made using heat of fusion of indium.

Specifically, about 10 mg of the toner or the wax is accurately weighed and placed in an aluminum-made pan, and as a reference, a blank aluminum-made pan is used. Measurement is performed in a measuring temperature range of 20° C.-140° C. at a rate of temperature rise of 10° C./min in a first temperature rise process. Then the pan is maintained at 140° C. for 10 min. and is thereafter cooled from 140° C. to 20° C. at a rate of 10° C./min. Thereafter, measurement is performed again in the temperature range of 20° C.-140° C. at the rate of temperature rise of 10° C./min in a second temperature rise process.

The heat absorption amount is obtained from an area surrounded by a fusion (melting) peak and a rectilinear line connecting a point where the fusion peak rises from an extrapolation base line before the fusion peak and a point of contact of the fusion peak and an extrapolation base line after end of the fusion peak. The wax compatible amount is obtained from the following formula (1).

$$\text{Wax compatible amount (weight \%)} = A - C \times 100/B \quad (1),$$

where A represents a wax amount (weight %) added in the toner, B represents the heat absorption amount (J/g) in the first temperature rise process when the wax is subjected to measurement using the DSC, and C represents the heat absorption amount (J/g) resulting from the wax in the second temperature rise process when the toner is subjected to the measurement using the DSC.

Embodiments 1 to 7

Embodiments of the present invention will be described specifically. However, these embodiments do not limit the present invention. In the following Embodiments and Comparison Examples, "parts" and "%" are on a weight basis.

In the following, a first formulation toner comprises toner particles in which a binder resin and a wax are contained in such an amount that 3 weight parts or more of the wax is contained per 100 weight parts of the binder resin, and in which the wax is only a hydrocarbon wax or a mixture of the hydrocarbon wax and a wax other than the hydrocarbon wax which is contained in a larger amount than the wax. Alternatively, the first toner comprises toner particles containing 3 weight parts or more of the wax per 100 weight parts of the binder resin and have a wax compatible amount with the binder resin of less than a predetermined amount A (wt. %) as measured by the differential scanning calorimetric analysis.

Further, a second formulation toner comprises toner particles in which a binder resin and a wax are contained in such an amount that 3 weight parts or more of the wax is contained per 100 weight parts of the binder resin, and in which the wax is only an ester wax or a mixture of the ester wax and a wax other than the ester wax which is contained in a larger amount than the wax. Alternatively, the first toner comprises toner particles containing 3 weight parts or more of the wax per 100 weight parts of the binder resin and have a wax compatible amount with the binder resin of not less than a predetermined amount A (wt. %) as measured by the differential scanning calorimetric analysis.

<Manufacturing Embodiment of Polyester Resin>

| | |
|---|---|
| Terephthalic acid | 15.00 weight parts |
| Isophthalic acid | 15.00 weight parts |
| Bisphenol A-propyl oxide-2-mol.-adduct | 70.00 weight parts |
| Potassium titanium oxalate dihydrate | 0.03 weight part |

In an autoclave equipped with a decompression device, a water separating device, a nitrogen gas introducing device, a temperature measuring device and a stirring device, the above-described ingredients were placed and were subjected to reaction for 17 hours at 220° C. in a nitrogen atmosphere, followed by further reaction for 0.5 hour under a reduced pressure of 10-20 mmHg. Thereafter, the reaction mixture was decreased in temperature to 180° C., and 0.10 weight part of trimellitic anhydride was added, followed by reaction for 2.0 hours at 175° C., so that polyester resin was obtained. The thus-obtained polyester resin was 9,500 in weight-average molecular weight (Mw), 73° C. in glass transition temperature (Tg) and 8.0 mgKOH/g in acid value (Av).

<Manufacturing Embodiment of Yellow Toner 1 (Y1)>

With respect to 60.0 weight parts of styrene, 5.0 weight parts of C.I. Pigment Yellow 155 and 1.0 weight part of a charge control agent ("BONTRON E88", manufactured by Orient Chemical Industries Co., Ltd.) were prepared. These ingredients were introduced into an attritor (manufactured by Nippon Coke & Engineering Co., Ltd.) and then were stirred for 180 min. at 25° C. and 200 rpm by using zirconia beads of 1.25 mm in radius, so that a pigment-dispersed composition was prepared.

On the other hand, in a separate container, 900 weight parts of ion-exchanged water warmed to 60° C. and 2.5 weight parts of tricalcium phosphate were placed and was stirred at 10000 rpm by using TK homomixer (manufactured by PRIMIX Corp.), so that an aqueous solvent was obtained.

Further, by the TK homomixer, the following ingredients were mixed and dispersed at 5000 rpm.

| | |
|---|---|
| Pigment-dispersed composition | 66.0 weight parts |
| Styrene | 15.0 weight parts |
| n-Butyl acrylate | 25.0 weight parts |
| Polyester resin | 5.0 weight parts |

Then, the ingredients were warmed to 60° C. and thereafter, 8.0 weight parts of a hydrocarbon wax ("HNP-9", manufactured by Nippon Seiro Co., Ltd.) was added followed by dispersion and mixing for 30 min. In the mixture, 10.0 weight parts of a polymerization initiator (2, 2'-azobis (2,4-dimethylvaleronitrile)) was dissolved, so that a polymerizable monomer composition was prepared.

In the aqueous solvent, the polymerizable monomer composition was added, followed by stirring for 10 min at 60° C. and 10000 rpm in a nitrogen atmosphere by using the TK homomixer, so that the polymerizable monomer composition was formed into particles. Thereafter, the composition was increased in temperature to 70° C. while being stirred by a stirring paddle blade. After reaction for 5 hours, the composition was further increased in temperature to 85° C., followed by reaction for 2 hours. After cooling, hydrochloric acid was added so that pH of the composition was 1.4, followed by stirring for 2 hours to obtain toner particles. The toner particles were filtered and washed with water, and thereafter were dried for 48 hours at a temperature of 40° C., so that yellow toner particles 1 were obtained.

When the thus-obtained yellow toner particles 1 were subjected to measurement of a weight-average particle size (D4) by a coulter counter ("Multisizer 3", manufactured by Beckman Coulter K.K.), the value of D4 was 6.2 μm.

To 100.0 weight parts of the yellow toner particles 1, 1.0 weight part of hydrophobic silica fine powder (number-average primary particle size: 7 nm) surface-treated with dimethylsilicone oil was externally added as inorganic fine powder). The mixture was dry-mixed for 10 min. by Henschel mixer (manufactured by Nippon Coke & Engineering Co., Ltd.), so that Y1 toner was obtained. A wax compatible amount of the Y1 toner was 1.4 wt. %.

<Manufacturing Embodiment of Yellow Toners 2 to 4, Magenta Toners 1 to 4, Cyan Toners 1 to 4 and Black Toners 1 to 4>

The pigment added in Manufacturing Embodiment of yellow toner 1 (Y1) was changed to pigments suitable for the respective colors, and the species and an addition amount of the wax were changed to those shown in Table 2. Other constitutions were the same as those in Manufacturing Embodiment of yellow toner 1 (Y1) described above, with the result that yellow toners 2 to 4 (Y2 to Y4), magenta toners 1 to 4 (M1 to M4) cyan toners 1 to 4 (C1 to C4) and black toners 1 to 4 (K1 to K4) were manufactured. Physical properties of the thus-obtained toners are shown in Table 2.

TABLE 2

| Toner formulation | Wax Species of wax | AA*1 | WCA*2 |
|---|---|---|---|
| Y1 | HNP-9 | 8.0 | 1.4 |
| M1 | (hydrocarbon) | | |
| C1 | | | |
| K1 | | | |
| Y2 | Behenyl behenate | 8.0 | 2.7 |
| M2 | (ester) | | |
| C2 | | | |
| K2 | | | |
| Y3 | Behenyl behenate | 6.0 | 2.8 |
| M3 | (ester) | | |
| C3 | NHP-9 | 2.0 | |
| K3 | (hydrocarbon) | | |
| Y4 | HNP-9 | 7.5 | 1.9 |
| M4 | (hydrocarbon) | | |
| C4 | Behenyl behenate | 0.5 | |
| K4 | (ester) | | |

*1"AA" represents the addition amount (weight part(s)).
*2"WCA" represents the wax compatible amount (weight %).

<Evaluation Method>

As an evaluating machine, a laser printer "LBP 9600C", manufactured by Canon Inc.) was used. In the evaluating machine, the yellow toner 1 (Y1), the magenta toner 1 (M1), the cyan toner 1 (C1) and the black toner 1 (K1) were replaced with those in the yellow cartridge, the magenta cartridge, the cyan cartridge and the black cartridge, respectively. Evaluation of pressing roller contamination was made in a low-temperature and low-humidity environment (15° C., 10% RH). A print mode is a normal mode for full-color printing.

A recording material S used for evaluation was "UPM Copykid" (basis weight: 70 g/m$^2$), and a mixture image of halftone images and characters of Y, M, C, K was outputted. A level of contamination of the pressing roller 19 after one-sheet print job was repeated until 3000 sheets in total were passed through a development of the evaluating machine was evaluated by visual observation on the basis of the following evaluation criterion. An evaluation result is shown in Table 3 appearing hereinafter. In Table 3, the content of the toner used is a proportion of the toner used in one toner purging operation.

Level A: The contamination did not generate.

Level B: The contamination generated in a trace amount.

Level C: Slight contamination generated.

Level D: A contamination film covered a part of the pressing roller.

Level E: A contamination film covered substantially a full circumference of the pressing roller.

TABLE 3

| | Toner formulation | TCPTP*1 (%) | Pressing roller contamination level |
|---|---|---|---|
| EMB. 1 | Y1 | 100.0 | A |
| | M1 | 0.0 | A |
| | C2 | 0.0 | A |
| | K2 | 0.0 | A |
| EMB. 2 | Y1 | 50.0 | A |
| | M1 | 50.0 | A |
| | C2 | 0.0 | A |
| | K2 | 0.0 | A |
| EMB. 3 | Y1 | 97.0 | B |
| | M1 | 1.0 | B |
| | C2 | 1.0 | B |
| | K2 | 1.0 | B |

TABLE 3-continued

| | Toner formulation | TCPTP*1 (%) | Pressing roller contamination level |
|---|---|---|---|
| EMB. 4 | Y4 | 100.0 | B |
| | M1 | 0.0 | B |
| | C2 | 0.0 | B |
| | K2 | 0.0 | B |
| COMP. EX. 1 | Y1 | 25.0 | D |
| | M1 | 25.0 | D |
| | C2 | 25.0 | D |
| | K2 | 25.0 | D |
| COMP. EX. 2 | Y1 | 50.0 | D |
| | M2 | 50.0 | D |
| | C2 | 0.0 | D |
| | K2 | 0.0 | D |
| COMP. EX. 3 | Y3 | 100.0 | E |
| | M1 | 0.0 | E |
| | C2 | 0.0 | E |
| | K2 | 0.0 | E |

*1"TCPTP" represents a toner content per (one) toner purging.

Embodiment 1

As shown in Table 1, in Embodiment 1, as the purged toner 44, only the Y1 toner (first formulation toner) containing only the hydrocarbon wax having the wax compatible amount of 1.4% was used. For that reason, a parting property during high temperature was not lowered, so that the evaluation level was level A at which the pressing roller contamination did not generate.

Embodiment 2

The evaluation similar to that in Embodiment 1 was made using the toner shown in Table 3. An evaluation result is also shown in Table 3. In Embodiment 2, as the purged toner 44, only the Y1 and M1 toners (first formulation toner) each containing only the hydrocarbon wax having a good parting property during high temperature and having the wax compatible amount of 1.4% were used, and therefore the evaluation level was the level A at which the pressing roller contamination did not generate.

Embodiment 3

The evaluation similar to that in Embodiment 1 was made using the toner shown in Table 3. An evaluation result is also shown in Table 3. In Embodiment 3, 98% of the purged toner 44 consists of the Y1 and M1 toners (first formulation toner) each containing only the hydrocarbon wax having the wax compatible amount of 1.4%. The remaining is 1% of each of the C2 and K2 toners (second formulation toner) each containing only the ester wax having the wax compatible amount of 2.7%. This is a difference from Embodiment 1.

Even in the case of the M2, C2 and K2 toners (second formulation toner) having a poor parting property during high temperature, there is no problem when the toners are used as the purged toner 44 if the toners are used in a trace amount. That is, the good parting property of the hydrocarbon wax in the first formulation toner occupying most of the purged toner 44 is dominant, so that the pressing roller contamination was at the level B at which the contamination generated in a trace amount.

Embodiment 4

The evaluation similar to that in Embodiment 1 was made using the toner shown in Table 3. An evaluation result is also shown in Table 3. In Embodiment 4, as the purged toner 44, only the Y4 toner (first formulation toner) containing the hydrocarbon wax having a good parting property during high temperature and having the wax compatible amount of 1.9% in a large amount was used. Although the ester wax was contained in a trace amount in the Y4 toner (Table 3), the hydrocarbon wax was contained in a large amount and the wax compatible amount is 1.9% which is small, and therefore the pressing roller contamination was at the level B at which the contamination generated in a trace amount without causing a lowering in parting property during high temperature.

Comparison Example 1

The evaluation similar to that in Embodiment 1 was made using the toner shown in Table 3. An evaluation result is also shown in Table 3. In Comparison Example 1 as a part of the purged toner 44, only the Y1 and M1 toners (first formulation toner) each containing only the hydrocarbon wax having a good parting property during high temperature and having the wax compatible amount of 1.4% were used. However, the amount of the C2 and K2 toners (second formulation toner) each containing only the ester wax having a poor parting property during high temperature and having the wax compatible amount of 2.7% is large. For that reason, the pressing roller contamination level was not good, i.e., was the level D at which a contamination film covered a part of the pressing roller.

Comparison Example 2

The evaluation similar to that in Embodiment 1 was made using the toner shown in Table 3. An evaluation result is also shown in Table 3. In Comparison Example 2 as a part of the purged toner 44, only the Y1 and M1 toners (first formulation toner) each containing only the hydrocarbon wax having a good parting property during high temperature and having the wax compatible amount of 1.4% were used. However, the amount of the M2 toner (second formulation toner) containing only the ester wax having a poor parting property during high temperature and having the wax compatible amount of 2.7% is large, and therefore, the pressing roller contamination level was not good, i.e., was the level D at which a contamination film covered a part of the pressing roller.

Comparison Example 3

The evaluation similar to that in Embodiment 1 was made using the toner shown in Table 3. An evaluation result is also shown in Table 3. In Comparison Example 2, the toner formulation itself is the same as that in Embodiment 3. However, as the purged toner 44, only the Y3 toner (second formulation toner) containing the ester wax having a poor parting property during high temperature in a large amount and having the wax compatible amount of 2.8% were used, and therefore the pressing roller contamination level was not good, i.e., was the level E at which a contamination film covered substantially a full circumference of the pressing roller.

In Embodiments 1 to 4, the example in which the toner (first formulation toner) containing only the hydrocarbon wax or containing the hydrocarbon wax in a large amount was used as the purged toner 44 was described. However, if the wax compatible amount is small (preferably be less than 2.0 wt. %), the wax used is not limited to the hydrocarbon wax, and another species of the wax can also achieve a similar effect.

Further, in Embodiments 1 to 4, as described above, it is possible to store a remaining amount of each of the toners by using the remaining toner amount detecting member 31 and the detection result storing means 32 which are provided at each of the process cartridges PY, PM, PC, PK. Accordingly, in the case where the remaining amount of the toner used as the purged toner 44 designated in Embodiments 1 to 4 is smaller than a predetermined value, another toner may also be temporarily used as the purged toner 44.

For example, in Embodiment 3, in the case where the remaining amount of the Y1 toner (first formulation toner) is less than the predetermined value, the M1 toner (first formulation toner) containing only the hydrocarbon wax having a good parting property during high temperature and having the wax compatible amount of 1.4% similarly as in the case of the Y1 toner is used as the purged toner 44. Further, in the case where both of the Y1 and M1 toners is less in remaining toner amount than the predetermined value, the C2 or K2 toner (second formulation toner) is used as the purged toner 44. That is, in the case where the remaining amount of the Y1, M1 toner (first formulation toner) is less than the predetermined amount, an operation in a toner supplying mode using only the C2, K2 toner (second formulation toner) or an operation in a toner supplying mode in which the C2, K2 toner is used in a larger amount than the Y1, M1 toner may also be executed.

The C2, K2 toner contains the ester wax having a poor parting property during high temperature in a large amount and has the wax compatible amount of 2.7%. However, the use of the C2, K2 toner is limited in a period until the process cartridges PY, PM including the Y1, M1 toners are exchanged with new ones of the process cartridges PY, PM and therefore most of the toner purging is performed using the Y1 (M1) toner advantageous for the pressing roller contamination. Accordingly, a degree of the influence on the pressing roller is small, so that a good level A can be maintained through the lifetime of the fixing device 17.

Although in Embodiments 1 to 4, the case of an operation in a full-color printing mode (during full-color printing) is described, Embodiments 1 to 4 can also be applied to an operation in a monochromatic printing mode. However, during the operation in the monochromatic printing mode, there is a device constitution shown below for preventing unnecessary deterioration and consumption of the toners of the colors (Y, M, C) and the photosensitive drums 1Y, 1M, 1C which are not used for the printing. That is, the constitution in which the developing rollers 3Y, 3M, 3C and the photosensitive drums 1Y, 1M, 1C are separated or the photosensitive drums 1Y, 1M, 1C and the intermediary transfer belt 8 are separated is employed.

In such a separation constitution, in the case where an unnecessary time for causing each of the members to contact the associated member from the separated state is intended to be taken in order to perform the toner purging operation, only during the operation in the monochromatic printing mode, the K toner may also be used as the purged toner. For example, as in the K2 toner (second formulation toner) in Embodiment 1, even in the case of the toner which contains only the ester wax having the poor parting property during high temperature and which has the wax compatible amount of 2.7%, as a manner of general use in the market, a ratio of the use in the operation in the full-color printing mode is high.

For that reason, with respect to the lifetime of the image forming apparatus, in most cases, the toner purging is performed using the Y1, M1 toners (first formulation toner) advantageous for the pressing roller contamination. Accordingly, a degree of the influence on the pressing roller contamination is small, so that the good level A can be maintained throughout the lifetime of the image forming apparatus.

The above constitution is summarized as follows. The toner particles used at the toner image forming portion 30 for forming the toner images on the moving intermediary transfer member 8 with the toner of at least two colors contains 3 weight parts or more of the wax per 100 weight parts of the binder resin. At least the toner of one of the colors is the first formulation toner in which the toner particles contain, as the wax, only the hydrocarbon wax or the hydrocarbon wax in a larger amount than another wax mixed with the hydrocarbon wax. Of other toners, at least the toner of one of the colors is the second formulation toner in which the toner particles contain, as the wax, only the ester wax or the ester wax in a larger amount than another wax mixed with the ester wax.

Then, in the toner purging operation, the purged toner 44 supplied to the cleaning blade 21 of the intermediary transfer member 8 is only the first formulation toner during one toner purging operation. Alternatively, in the toner purging operation, the toner supplied to the cleaning blade 21 of the intermediary transfer member 8 is the mixture of the first formulation toner and the second formulation toner in which the amount of the first formulation toner is larger than the amount of the second formulation toner during one toner purging operation. As a result, the pressing roller contamination (rotatable pressing member contamination) of the fixing device 17 due to the toner purging was able to be suppressed.

The particles used at the toner image forming portion 30 for forming the toner images on the moving intermediary transfer member 8 with the toner of at least two colors contain 3 weight parts or more of the wax per 100 weight parts of the binder resin. The toner particles of at least one color is the first formulation toner having the wax compatible amount, with the toner, which is less than a predetermined amount A (wt. %) as measured by the differential scanning calorimetric analysis. The toner particles of at least one of the other colors is the second formulation toner having the wax compatible amount, with the toner, which is not less than the predetermined amount (wt. %).

Then, in the toner purging operation, the purged toner 44 supplied to the cleaning blade 21 of the intermediary transfer member 8 is only the first formulation toner during one toner purging operation. Alternatively, in the toner purging operation, the toner supplied to the cleaning blade 21 of the intermediary transfer member 8 is the mixture of the first formulation toner and the second formulation toner in which the amount of the first formulation toner is larger than the amount of the second formulation toner during one toner purging operation. As a result, the pressing roller contamination (rotatable pressing member contamination) of the fixing device 17 due to the toner purging was able to be suppressed.

On the other hand, in the case where the pressing roller contamination was able to be suppressed, the purged toner deposited in a small amount on the back surface of the recording material S is fixed as it is on the back surface of the recording material S without depositing on the surface of the parting layer 19-*c* of the pressing roller 19, so that a print image is formed. At that time, the amount of the purged toner 44 fixed on the back surface of the recording material S is a trace amount, but in some cases, the purged toner 44 is visually recognizable by a user, and therefore there is also a possibility that the purged toner 44 leads to a lowering in image quality of the print image (so-called back surface contamination).

Accordingly, it can be said that the toner used as the purged toner 44 is preferred when not only the toner has the good parting property during high temperature as described in Embodiments 1 to 4 but also the toner has high brightness (L*) since the back surface contamination is less visually recognizable. In the following, this will be described in detail based on Embodiments 5 to 7 and Table 4.

TABLE 4

| | Toner formu-lation | L* | TCPTP*1 (%) | PRCL*2 | BSCVL*3 |
|---|---|---|---|---|---|
| EMB. 5 | Y1 | 89 | 100.0 | A | A |
| | M4 | 51 | 0.0 | A | A |
| | C2 | 55 | 0.0 | A | A |
| | K2 | 14 | 0.0 | A | A |
| EMB. 6 | Y4 | 92 | 80.0 | B | B |
| | M4 | 54 | 20.0 | B | B |
| | C2 | 56 | 0.0 | B | B |
| | K2 | 15 | 0.0 | B | B |
| EMB. 7 | Y1 | 89 | 98.0 | B | B |
| | M4 | 54 | 0.0 | B | B |
| | C2 | 55 | 1.0 | B | B |
| | K2 | 14 | 1.0 | B | B |
| COMP. EX. 4 | Y1 | 90 | 0.0 | A | D |
| | M4 | 52 | 0.0 | A | D |
| | C2 | 55 | 0.0 | A | D |
| | K1 | 13 | 100.0 | A | D |
| COMP. EX. 5 | Y2 | 92 | 0.0 | B | C |
| | M2 | 54 | 0.0 | B | C |
| | C4 | 56 | 80.0 | B | C |
| | K4 | 15 | 20.0 | B | C |
| COMP. EX. 6 | Y2 | 89 | 1.0 | B | D |
| | M2 | 54 | 1.0 | B | D |
| | C4 | 55 | 0.0 | B | D |
| | K1 | 14 | 98.0 | B | D |

*1"TCPTP" represents a toner content per (one) toner purging.
*2"PRCL" represents a pressing roller contamination level.
*3"BSCVL" represents a back surface contamination visible level.

Embodiment 5

Using the toner shown in Table 4, evaluation of pressing roller contamination similar to that in Embodiment 1 and evaluation of back surface contamination were made. The evaluation of the back surface contamination was carried out in the same manner as in the pressing roller contamination, so that a level of the back surface contamination of the recording material was evaluated by visual observation on the basis of the following evaluation criteria. Incidentally, a value of L* is a value obtained by measuring chromacity by a measuring device ("Spectrolino", manufactured by GretagMacbeth Corp.) when the toner of each of the colors is placed in an amount of 0.4 mg/cm$^2$ on paper ("CFC-081", available from Canon Inc.).

Level A: It was difficult to visually recognize the back surface contamination.

Level B: It was possible to slightly visually recognize the back surface contamination.

Level C: It was possible to visually recognize the back surface contamination.

Level D: It was possible to easily visually recognize the back surface contamination.

An evaluation result as shown in Table 4. In Embodiment 5, only the Y1 toner (first toner) containing only the hydrocarbon wax having a good parting property during high temperature and having the wax compatible amount of 1.4% is used as the purged toner 44. For that reason, the pressing roller contamination level was the level A at which the pressing roller contamination did not generate. Further, the Y1 toner has L*=89 which is high, and therefore the back surface contamination level was also the level A at which it was difficult to visually recognize the back surface contamination.

Embodiment 6

Using the toners shown in Table 4, the pressing roller contamination evaluation and the back surface contamination evaluation were made similarly as in Embodiment 5. In Embodiment 6, the Y4 and M4 toners (first formulation toner) each containing the hydrocarbon wax with a good parting property during high temperature in a large amount and having the wax compatible amount of 1.9% are used as the purged toner 44. For that reason, the pressing roller contamination level was the level B at which the pressing roller contamination generated in the trace amount. Further, 80% of the Y4 toner having L*=92 and 20% of the M4 toner having L*=54 were used as the purged toner 44, and therefore also the back surface contamination level was the level B at which it was possible to slight visually recognize the back surface contamination.

Embodiment 7

Using the toners shown in Table 4, the pressing roller contamination evaluation and the back surface contamination evaluation were made similarly as in Embodiment 5. In Embodiment 7, 98% of the purged toner 44 consists of the Y1 toner (first formulation toner) containing only the hydrocarbon wax having the good parting property during high temperature and having the wax compatible amount of 1.4%. For that reason, even when 1% of the C2 toner and 1% of the K2 toner which were the second formulation toner containing only the ester wax having the poor parting property during high temperature and having the wax compatible amount of 2.7% were contained, the pressing roller contamination level was the level B at which the pressing roller contamination generated in the trace amount.

Further, 98% of the purged toner 44 was the Y1 toner (first formulation toner) having L*=89, and therefore even when 1% of the C2 toner having L*=55 and 1% of the K2 toner having L*=14 were contained, also the back surface contamination level was the level B at which it was possible to slightly visually recognize the back surface contamination.

Comparison Example 4

Using the toner shown in Table 4, the pressing roller contamination evaluation of pressing roller and the back surface contamination evaluation were made similarly as in Embodiment 5.

In Comparison Example 4, only the K1 toner (first toner) containing only the hydrocarbon wax having a good parting property during high temperature and having the wax compatible amount of 1.4% is used as the purged toner 44, and therefore, the pressing roller contamination level was the level A at which the pressing roller contamination did not generate. However, the K1 toner has L*=13 which is low, and therefore the back surface contamination level was the level D at which it was possible to easily visually recognize the back surface contamination.

Comparison Example 5

Using the toners shown in Table 4, the pressing roller contamination evaluation and the back surface contamination evaluation were made similarly as in Embodiment 5. In Comparison Example 5, the C4 and K4 toners (first formulation toner) each containing the hydrocarbon wax with a good parting property during high temperature in a large amount and having the wax compatible amount of 1.9% are used as the purged toner 44, and therefore, the pressing roller contamination level was the level B at which the pressing roller contamination generated in the trace amount. However, 80% of the C4 toner having L*=57 and 20% of the K4 toner having L*=16 were used as the purged toner 44, and therefore also the back surface contamination level was the level C at which it was possible to visually recognize the back surface contamination.

Comparison Example 6

Using the toners shown in Table 4, the pressing roller contamination evaluation and the back surface contamination evaluation were made similarly as in Embodiment 5. In Comparison Example 6, 98% of the purged toner 44 consists of the K1 toner (first formulation toner) containing only the hydrocarbon wax having the good parting property during high temperature and having the wax compatible amount of 1.4%. For that reason, even when 1% of the Y2 toner and 1% of the M2 toner which were the second formulation toner containing only the ester wax having the poor parting property during high temperature and having the wax compatible amount of 2.7% were contained, the pressing roller contamination level was the level B at which the pressing roller contamination generated in the trace amount.

However, 98% of the purged toner was the L1 toner (first formulation toner) having L*=14, and therefore, the back surface contamination level was the level D at which it was possible to easily visually recognize the back surface contamination.

Further, in Embodiments 5 to 7, as described above, it is possible to store a remaining amount of each of the toners by using the remaining toner amount detecting means 31 and the detection result storing means 32 which are provided at each of the process cartridges PY, PM, PC, PK. Accordingly, in the case where the remaining amount of the toner used as the purged toner 44 designated in Embodiments 5 to 7 is smaller than a predetermined value, another toner may also be temporarily used as the purged toner 44.

For example, in Embodiment 5, in the case where the remaining amount of the Y1 toner (first formulation toner) is less than the predetermined value, the M4 toner (first formulation toner) containing the hydrocarbon wax having a good parting property during high temperature and having the wax compatible amount of 1.9% in a large amount similarly as in the case of the Y1 toner is used as the purged toner 44. Further, in the case where both of the Y1 and M4 toners is less in remaining toner amount than the predetermined value, the C2 or K2 toner (second formulation toner) is used as the purged toner 44.

The C2, K2 toner contains the ester wax having a poor parting property during high temperature in a large amount and has the wax compatible amount of 2.7%. However, the use of the C2, K2 toner is limited in a period until the process cartridges PY, PM including the Y1, M4 toners are exchanged with new ones of the process cartridges PY, MY and therefore most of the toner purging is performed using the Y1 (M4) toner advantageous for the pressing roller contamination. Accordingly, a degree of the influence on the pressing roller 19 is small, so that a good level A can be maintained through the lifetime of the fixing device 17.

Further, also with respect to the value of L*, the toner having a low L* disadvantageous for the back surface contamination, e.g., the K2 toner (second formulation toner) has a poor parting property during high temperature, and therefore the toner is deposited in a large amount on the pressing roller side, so that a proportion of the deposition thereof on the back surface of the paper becomes small. For that reason, the degree of the influence on the back surface contamination is small and is at a level of no problem.

Although in Embodiments 5 to 7, the case of an operation in a full-color printing mode (during full-color printing) is described, Embodiments 1 to 4 can also be applied to an operation in a monochromatic printing mode. However, during the operation in the monochromatic printing mode, there is a separation constitution as described above for preventing unnecessary deterioration and consumption of the toners of the colors (Y, M, C) and the photosensitive drums 1Y, 1M, 1C which are not used for the printing. In such a separation constitution, in the case where an unnecessary time for causing each of the members to contact the associated member from the separated state is intended to be taken in order to perform the toner purging operation, only during the operation in the monochromatic printing mode, the K toner (second formulation toner) may also be used as the purged toner 44.

For example, as in the K2 toner (second formulation toner) in Embodiment 5, even in the case of the toner which contains only the ester wax having the poor parting property during high temperature and which has the wax compatible amount of 2.7%, as a manner of general use, a ratio of the use in the operation in the full-color printing mode is high. For that reason, with respect to the lifetime of the image forming apparatus, in most cases, the toner purging is performed using the Y1, M1 toners (first formulation toner) advantageous for the pressing roller contamination.

Accordingly, a degree of the influence on the pressing roller contamination is small, so that the good level A can be maintained throughout the lifetime of the image forming apparatus. Further, also with respect to the value of L*, the toner having a low L* disadvantageous for the back surface contamination, e.g., the K2 toner (second formulation toner) has a poor parting property during high temperature. For that reason, the toner is deposited in a large amount on the pressing roller side, so that a proportion of the deposition thereof on the back surface of the paper becomes small, and therefore, the degree of the influence on the back surface contamination is small and is at a level of no problem.

As described above, the toner having a highest brightness is the first formulation toner. Further, by using, as the purged toner 44, this toner which contains the hydrocarbon wax with the good parting property during high temperature or has the small wax compatible amount and which has the high value of L*, it is possible to simultaneously suppress the pressing roller contamination and the back surface contamination.

Other Embodiments (1) The image forming apparatus 100 may also employ a constitution in which the toner image forming portion 30 for forming the toner images on the moving intermediary transfer member 8 with the toners of at least two colors and in which the belt is used as the intermediary transfer member 8 in the embodiments described above.

(2) A toner image forming principle and an image forming process at the toner image forming portion are not limited to the electrophotographic process. An electrostatic recording process of an intermediary transfer type using a dielectric member as the image bearing member and a magnetic recording process of an intermediary transfer type using a magnetic material, and the like may also be used.

(3) The colors of the toners are not limited to Y, M, C, K. The colors may also include other various colors such as red, green and blue. The toners may further include characteristic color toners such as a white toner, a clear (transparent) toner, and a fluorescent toner.

(4) The developing system may be a developing system using a one-component developer or a developing system using a two-component developer.

(5) The constitution of the fixing portion is not limited to the device constitution of the film heating type in the above-described embodiments. The rotatable heating member may also be a roller member. The rotatable pressing member may also be an endless belt. The heating type of the rotatable heating member may also be an electromagnetic induction heating type or a heat radiation type.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-152887 filed on Jul. 28, 2014, which is hereby incorporated by reference herein in its entirety.

What is claimed is:

1. An image forming apparatus for forming a toner image on a recording material, comprising:

an image forming portion for forming the toner image, formed with toners of a plurality of colors, on an intermediary transfer member;

a transfer member for forming a transfer nip in contact and cooperation with the intermediary transfer member, said transfer member transferring the toner image from the intermediary transfer member onto the recording material while feeding the recording material in the transfer nip;

a fixing portion for fixing the toner image on the recording material by heating the recording material on which the toner image is transferred while feeding the recording material in a fixing nip, said fixing portion including a heating member and a pressing member for forming the fixing nip in cooperation with the heating member; and a cleaning member for cleaning a surface of the intermediary transfer member in contact with the intermediary transfer member, said cleaning member being provided between said image forming portion and the transfer nip with respect to a movement direction of the intermediary transfer member, wherein toner particles of each of the toners contain a binder resin and a wax which is contained in an amount of 3 weight parts or more per 100 weight parts of the binder resin, wherein said image forming apparatus at least includes a first toner container containing a first formulation toner in which the wax is only a hydrocarbon wax or a mixture of the hydrocarbon wax and a wax other than the hydrocarbon wax which is contained in a larger amount than the wax and includes a second toner container containing a second formulation toner in which the wax is only an ester wax or a mixture of the ester wax and a wax other than the ester wax which is contained in a larger amount than the wax, wherein said image forming apparatus is capable of executing an image forming operation for forming the toner image on the intermediary transfer member at said image forming portion to form the toner image on the recording material, and is capable of executing an operation in a toner supplying mode for supplying the toner or the toners to the intermediary transfer member at said image forming portion to dispose the toner or the toners between said cleaning member and the intermediary transfer member at predetermined timing when the image forming operation is not performed, and wherein said image forming apparatus is capable of executing the operation in the toner supplying mode in which only the first formulation toner is used or a mixture of the first formulation toner and the second formulation toner is used so that the first formulation toner is used in a larger amount than the second formulation toner.

2. The image forming apparatus according to claim 1, wherein of the toners, the toner having highest brightness is the first formulation toner.

3. The image forming apparatus according to claim 1, wherein the toner contains inorganic powder as an external additive for the toner particles.

4. The image forming apparatus according to claim 1, wherein when a remaining amount of the first formulation toner is a predetermined amount or less, said image forming apparatus executes the operation in the toner supplying mode in which only the second formulation toner is used or a mixture of the first formulation toner and the second formulation toner is used so that the second formulation toner is used in a larger amount than the first formulation toner.

5. An image forming apparatus for forming a toner image on a recording material, comprising:

an image forming portion for forming the toner image; formed with toners of a plurality of colors, on an intermediary transfer member;

a transfer member for forming a transfer nip in contact and cooperation with the intermediary transfer member, said transfer member transferring the toner image from the intermediary transfer member onto the recording material while feeding the recording material in the transfer nip;

a fixing portion for fixing the toner image on the recording material by heating the recording material on which the toner image is transferred while feeding the recording material in a fixing nip, said fixing portion including a heating member and a pressing member for forming the fixing nip in cooperation with the heating member; and a cleaning member for cleaning a surface of the intermediary transfer member in contact with the intermediary transfer member, said cleaning member being provided between said image forming portion and the transfer nip with respect to a movement direction of the intermediary transfer member, wherein toner particles of each of the toners contain, a binder resin and a wax which is contained in an amount of 3 weight parts or more per 100 weight parts of the binder resin, wherein said image forming apparatus at least includes a first toner container containing a first formulation toner in which a compatible amount of the wax with the binder resin measured by differential scanning colorimetric analysis is less than a predetermined amount and includes a second toner container containing a second formulation toner in which the compatible amount of the wax with the binder resin is the predetermined amount or more, wherein said image forming apparatus is capable of executing an image forming operation for forming the toner image on the intermediary transfer member at said image forming portion to form the toner image on the recording material, and is capable of executing an operation in a toner supplying mode for supplying the toner or the toners to the intermediary transfer member at said image forming portion to dispose the toner or the toners between said cleaning member and the intermediary transfer member at predetermined timing when the image forming operation is not performed, and wherein said image forming apparatus is capable of executing the operation in the toner supplying mode in which only the first formulation toner is used or a mixture of the first formulation toner and the second formulation toner is used so that the first formulation toner is used in a larger amount than the second formulation toner.

6. The image forming apparatus according to claim 5, wherein of the toners, the toner having highest brightness is the first formulation toner.

7. The image forming apparatus according to claim 5, wherein the toner contains inorganic powder as an external additive for the toner particles.

8. The image forming apparatus according to claim 5, wherein when a remaining amount of the first formulation toner is a predetermined amount or less, said image forming apparatus executes the operation in the toner supplying mode in which only the second formulation toner is used or a mixture of the first formulation toner and the second formulation toner is used so that the second formulation toner is used in a larger amount than the first formulation toner.

* * * * *